US005850194A

United States Patent [19]

Lin

[11] Patent Number: 5,850,194

[45] Date of Patent: Dec. 15, 1998

[54] COMPUTER KEY

[75] Inventor: Jie-Tsung Lin, Taipei, Taiwan

[73] Assignee: Peripheral Technology, Inc., Taipei, Taiwan

[21] Appl. No.: 995,309

[22] Filed: Dec. 22, 1997

[51] Int. Cl.[6] ..... H01H 3/12

[52] U.S. Cl. ..... 341/22; 200/5 A; 200/344; 361/680

[58] Field of Search ..... 341/22, 20, 34; 200/51.1, 442, 345, 344, 5 A; 361/680

[56] References Cited

U.S. PATENT DOCUMENTS

| | | | |
|---|---|---|---|
| 5,457,297 | 10/1995 | Chen | 200/344 |
| 5,463,195 | 10/1995 | Watanabe | 200/5 A |
| 5,504,283 | 4/1996 | Kako | 200/5 A |
| 5,519,569 | 5/1996 | Sellers | 361/680 |
| 5,555,971 | 9/1996 | Takada | 200/345 |
| 5,562,203 | 10/1996 | Mochizuki | 200/345 |
| 5,587,875 | 12/1996 | Sellers | 361/680 |
| 5,590,020 | 12/1996 | Sellers | 361/680 |
| 5,625,532 | 4/1997 | Sellers | 200/344 |
| 5,657,860 | 8/1997 | Koike | 200/344 |
| 5,735,390 | 4/1998 | Takagi | 200/344 |
| 5,767,464 | 6/1998 | Dyer | 200/5 A |

*Primary Examiner*—Brian Zimmerman
*Assistant Examiner*—Albert K. Wong
*Attorney, Agent, or Firm*—Fish & Richardson P.C.

[57] ABSTRACT

A computer key includes a one-piece base plate which is punched to form left and right retaining guideways that are spaced from each other in a longitudinal direction of the base plate. The retaining guideways include left and right retaining portions which extend uprightly from the base plate, and left and right blocking portions which extend from distal ends of the retaining portions away from each other and substantially longitudinal to the base plate. The blocking portions have left and right widths defined in a direction transverse to the longitudinal direction by front and rear left and right rough edges. A frame assembly includes first and second linking frames which are pivotally connected at intermediate portions thereof. Each of the first and second linking frames includes a transverse axle oriented in a transverse direction of the base plate, and has a middle segment of a length shorter than the width of the respective blocking portion and insertable sliably under the respective blocking portion, and front and rear segments which extend beyond the front and rear rough edges of the respective blocking portion. The front and rear segments of the transverse axles respectively have cut-out upper surfaces which do not contact the rough edges of the respective blocking portion.

8 Claims, 4 Drawing Sheets

COMPUTER KEY

BACKGROUND OF THE INVENTION

1. Field of the Invention

The invention relates to a computer key, more particularly to a computer key which includes a pair of pivotally connected linking frames disposed between a base plate and a push button, wherein the base plate permits smooth sliding movement of lower portions of the linking frames thereon.

2. Description of the Related Art

Referring to FIGS. 1 and 2, a known computer key is shown to include a one-piece base plate 10, a membrane circuit 11, a flexible sheet member 12, an upright biasing member 14, a frame unit 13 and a push button 15.

As illustrated, the base plate 10 is punched to form first left and right retaining members 10B, 10A which are spaced apart from each other in a longitudinal direction of the base plate 10, and which extend upwardly from an upper surface of the base plate 10 to block movement in an upward and normal direction relative to a plane of the upper surface. The first left and right retaining members 10B, 10B cooperatively define an actuation area therebetween.

The membrane circuit 11 is disposed on the base plate 10, and has a contact area 11A superimposed upon the actuation area, and first left and right openings 11B which are disposed to correspond with the first left and right retaining members 10B, 10A to permit the latter to extend outwardly through the first left and right openings 11B.

The sheet member 12 is superimposed on the membrane circuit 11, and defines an actuation transmitting area (not visible), an annular mounting area (not visible) around the actuation transmitting area, and second left and right openings 12B which are aligned with the first left and right openings 12B to permit the first left and right retaining members 10B, 10A to extend outwardly through the second left and right openings 12B.

The biasing member 14 is disposed on the annular mounting area of the sheet member 12, and has an upper depressing portion 141 and a spacing lower portion 142 for separating the upper depressing portion 141 from the actuation transmitting area. The upper depressing portion 141 of the biasing member 14 is movable against the biasing action thereof to depress the actuation transmitting area as well as the contact area 11A of the membrane circuit 11 to generate an electrical signal.

The push button 15 is disposed to actuate the biasing member 14, and has second left and right retaining members 15A, 15B in an underside thereof and in diagonal positions relative to the first left and right retaining members 10B, 10A of the base plate 10.

The frame unit 13 includes first and second linking frames having first and second pairs of linking arms which are connected pivotally at intermediate portions thereof. The first and second linking frames further have first and second transverse axles 130, 131 extended into the first left and right retaining members 10B, 10A of the base plate 10, and first and second pairs of hooking fingers 131A, 130A retained in the second left and right retaining members 15A, 15B.

Note that the first left retaining members 10B on the base plate 10, and the second left retaining members 15B of the push button 15 should have sufficient length in the longitudinal direction of the base plate 10 to permit sliding movement of the first transverse axle 130 and the hooking fingers 130A when a downward force is applied on the push button 15. However, the first left retaining members 10B of the base plate 10 have front and rear rough edges 101, 102 which are formed by virtue of the punching and which engage frictionally the upper surface of the first transverse axle 130, thereby hindering the sliding movement of the transverse axle 130 in the retaining members 10B. Although the rough edges 101, 102 of the retaining member 10B can be smoothed manually or with the use of a machine, such action will prolong the assembly time and result in increased production costs.

Referring to FIG. 3, to overcome the aforementioned drawbacks, another known computer key is shown to include an extra plastic upper plate 17 as compared to the previous computer key. The upper plate 17 is disposed on the flexible sheet member 12 and has a left retaining member 170 of a sufficient length in the longitudinal direction of the same without the rough edges of the retaining members 10B of the previous computer key to permit sliding movement of the transverse axle 130 therein. However, the overall height of the computer key of this type is increased.

SUMMARY OF THE INVENTION

Therefore, the object of this invention is to provide a computer key which is clear of the aforesaid drawbacks that are associated with the known computer keys.

Accordingly, a computer key of this invention includes a one-piece base plate, a membrane circuit, a flexible sheet member, an upright elastomeric biasing member, a first linking frame, a second linking frame, and a push button. The base plate includes left and right slidably retaining guideways which are spaced apart from each other in a longitudinal direction of the base plate to define an actuation area therebetween. The left and right slidably retaining guideways are respectively formed by punching the base plate so as to have left and right retaining portions which respectively extend uprightly from an upper surface of the base plate, and left and right blocking portions which extend respectively from distal ends of the left and right retaining portions away from each other and substantially longitudinal to the base plate so as to block movement in an upward and normal direction relative to a plane of the upper surface of the base plate. The left and right blocking portions have left and right widths defined in a transverse direction relative to the longitudinal direction of the base plate by front and rear left edges and front and rear right edges, respectively. The membrane circuit is disposed on the upper surface of the base plate, and has a contact area superimposed upon the actuation area, and first left and right openings which match positions of the left and right blocking portions so as to permit extension of the left and right blocking portions outwardly of the first left and right openings. The sheet member is superimposed on the membrane circuit, and defines an actuation transmitting area and an annular mounting area which surrounds the actuation transmitting area. The actuation transmitting area is of a dimension matching that of and is superimposed on the contact area of the membrane circuit. The sheet member further has second left and right openings aligned with the first left and right openings to permit extension of the left and right blocking portions outwardly through the second left and right openings.

The biasing member is disposed on the mounting seat area of the sheet member, and includes an upper depressing portion and a spacing lower portion to space the upper depressing portion from the mounting seat area. The upper depressing portion is movable against a biasing action thereof to depress the actuation transmitting area as well as the contact area of the membrane circuit to generate an electrical signal.

The first linking frame includes a first transverse axle and a pair of first linking arms. The first transverse axle is oriented in the transverse direction of the base plate, and has a first middle segment of a first length shorter than the right width and insertable slidably under the right blocking portion, and first front and rear segments which flank the first middle segment and which extend beyond the front and rear edges of the right blocking portion respectively in the transverse direction. Each of the first front and rear segments has a cut-out first upper surface such that, while the first middle segment slides under the right blocking portion, the first upper surface will not contact either of the front and rear edges of the right blocking portion. The first linking arms extend respectively and radially from the first front and rear segments, and have a pair of first hooking fingers which are disposed at distal ends thereof and which are parallel to the first transverse axle.

The second linking frame includes a second transverse axle and a pair of second linking arms. The second transverse axle is oriented in the transverse direction of the base plate, and has a second middle segment of a second length shorter than the left width and insertable slidably under the left blocking portion, and second front and rear segments which flank the second middle segment and which extend beyond the front and rear edges of the left blocking portion respectively in the transverse direction. Each of the second front and rear segments has a cut-out second upper surface such that while the second middle segment slides under the left blocking portion, the second upper surface will not contact either of the front and rear edges of the left blocking portion. The second linking arms extend respectively and radially from the second front and rear segments, and have a pair of second hooking fingers which are disposed at distal ends thereof and which are parallel to the second transverse axle. The first and second linking arms are connected pivotally to each other at intermediate portions thereof such that the first and second linking arms cooperatively confine a space to accommodate depressing movement of the biasing member when the first and second middle segments are inserted into and are retained slidably under the right and left blocking portions, respectively.

The push button is disposed to actuate the depressing portion of the biasing member, and has left and right hingeably retaining members disposed in an underside thereof and spaced apart so as to hingeably retain the first and second pairs of hooking fingers, respectively.

BRIEF DESCRIPTION OF THE DRAWINGS

Other features and advantages of this invention will become more apparent in the following preferred embodiment with reference to the accompanying drawings, in which.

DETAILED DESCRIPTION OF THE PREFERRED EMBODIMENT

Figure 1:
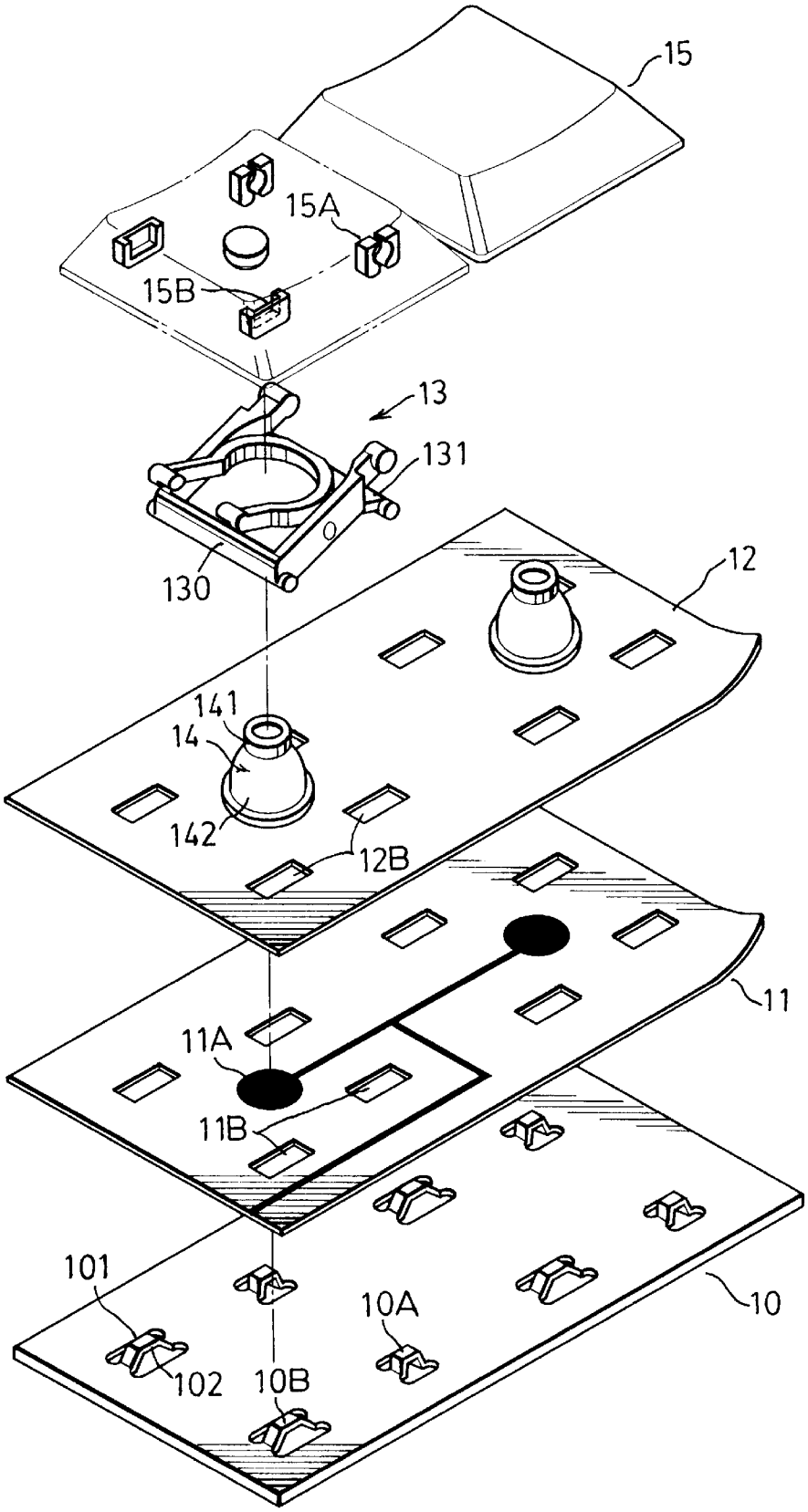
FIG. 1 PRIOR ART
FIG. 1 is an exploded view of a known computer key.
Figure 2:
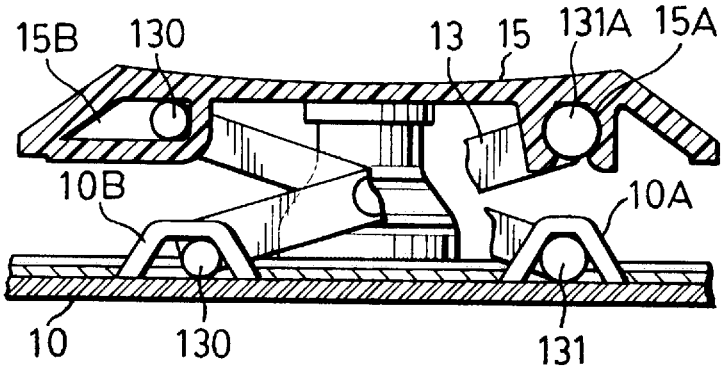
FIG.2 PRIOR ART
FIG. 2 is a sectional view of the known computer key of FIG. 1.
Figure 3:
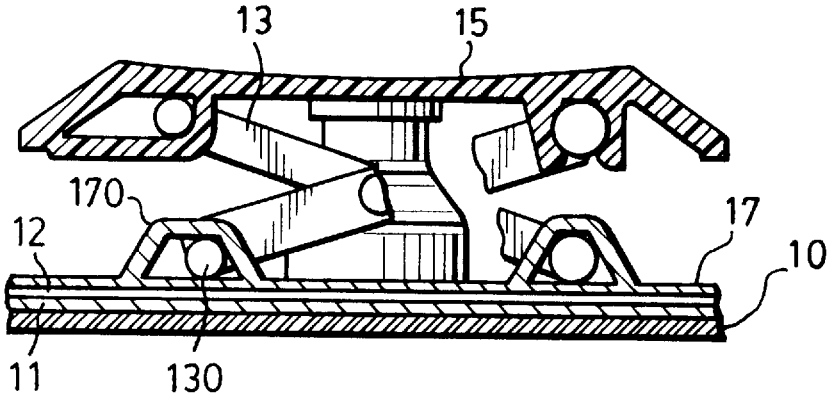
FIG.3 PRIOR ART
FIG. 3 is a sectional view of another known computer key.
Figure 4:
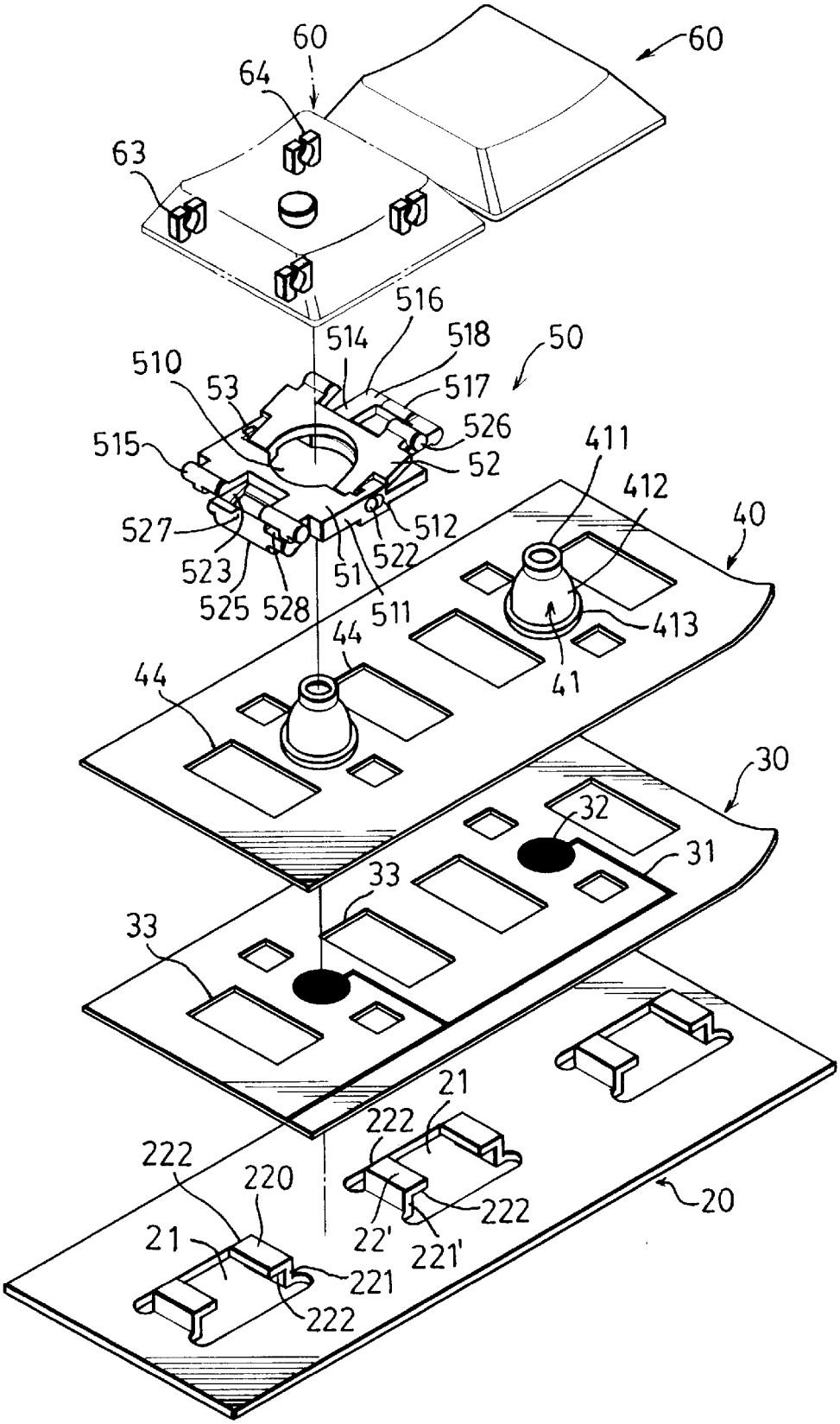
FIG. 4 is an exploded view of a preferred embodiment of computer key according to this invention.
Figure 5:
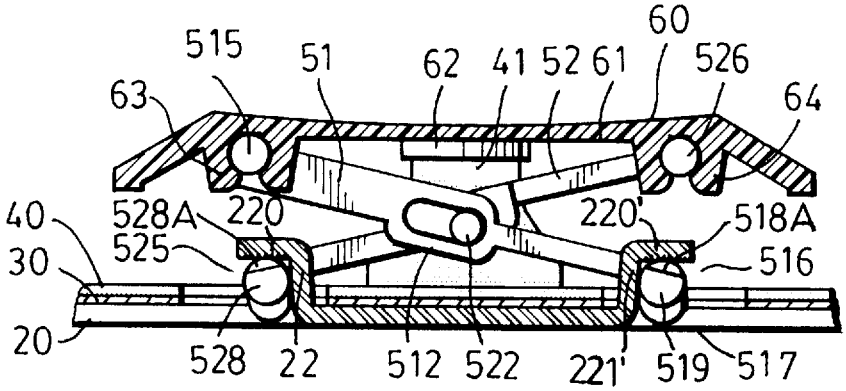
FIG. 5 is a partly sectional view of the preferred embodiment, illustrating the preferred embodiment in an assembled state.
Figure 6:
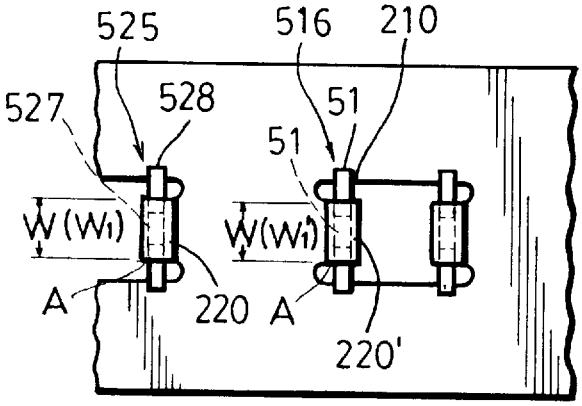
FIG. 6 is a fragmentary top view of the preferred embodiment to illustrate the connection between the linking frame and the base plate.

Referring to FIGS. 4, 5 and 6, the preferred embodiment of a computer key according to this invention is shown to include a one-piece base plate 20, a membrane circuit 30, a flexible sheet member 40, an upright elastomeric biasing member 41, a push button 60, and a frame assembly 50 consisting of first and second linking frames 51, 52.

As illustrated, the base plate 20 includes left and right slidably retaining guideways 21 spaced apart from each other in a longitudinal direction of the base plate 20 to define an actuation area therebetween. The left and right slidably retaining guideways 21 are respectively formed by punching the base plate 20 so as to have left and right retaining portions 221, 221' which extend uprightly from an upper surface of the base plate 20, and left and right blocking portions 220, 220' which extend from distal ends of the left and right retaining portions 221, 221' respectively away from each other in a direction substantially longitudinal to the base plate 20 so as to block movement in an upward and normal direction relative to a plane of the upper surface. The left and right blocking portions 220, 220' have left and right widths (W) which are measured and defined in a transverse direction relative to the longitudinal direction of the base plate 20 by a first pair of front and rear left rough edges 222 and a second pair of front and rear right rough edges 222, respectively.

The membrane circuit 30 is disposed on the upper surface of the base plate 20, and has a contact area 32 of a dimension corresponding to and superimposed upon the actuation area, and first left and right openings 33 which are disposed to match positions of the left and right blocking portions 220, 220' so as to permit extension of the latter through the first left and right openings 33.

The sheet member 40, generally made of plastic, is superimposed on the membrane circuit 30, and defines an actuation transmitting area (not visible) and an annular mounting area (not visible) around the actuation transmitting area. The actuation transmitting area is of a dimension matching that of and is superimposed on the contact area 32 of the membrane circuit 30. The sheet member 40 has second left and right openings 44 which are aligned with the first left and right openings 33 to permit extension of the left and right blocking portions 220, 220' outwardly through the second left and right openings 44.

The biasing member 41 is disposed on the mounting seat area of the sheet member 40, and includes an upper depressing portion 411 and a spacing lower portion 412 to space the upper depressing portion 411 from the mounting seat area. The upper depressing portion 411 of the biasing member 40 is movable against a biasing action thereof to depress the actuation transmitting area as well as the contact area 32 of the membrane circuit 30 to generate an electrical signal.

The first linking frame 51 includes a first transverse axle 516, and a pair of first linking arms 514. The first transverse axle 516 is oriented in the transverse direction of the base plate 20, and has a first middle segment 517 of a length (W1) shorter than the right width (W) and insertable sliably under the right blocking portion 220', and front and rear segments 518 which flank the first middle segment 517 and which extend beyond the front and rear rough edges 222 of the right blocking portion 220', respectively. Each of the front and rear segments 518 has a cut-out first upper surface 518A such that, while the first middle segment 517 slides under the right blocking portion 220', the first upper surface 518A will not contact either of the front and rear rough edges 222 of the right blocking portion 220'. The first linking arms 514 extend respectively and radially from the front and rear segments 518 of the first transverse axle 516, and have a pair of hooking fingers 515 which are disposed at distal ends thereof and which are parallel to the first transverse axle 516.

The second linking frame 52 includes a second transverse axle 525, and a pair of second linking arms 523. The second transverse axle 525 is oriented in the transverse direction of the base plate 20, and has a second middle segment 527 of a length (W1) shorter than the left width (W) and is insertable slidably under the left blocking portion 220, and front and rear segments 528 which flank the second middle segment 527 and which extend beyond the front and rear rough edges 222 of the left blocking portion 220, respectively. Each of the front and rear segments 528 has a cut-out second upper surface 528A such that, while the second middle segment 527 slides under the left blocking portion 220, the second upper surface 528A will not contact either of the front and rear rough edges 222 of the left blocking portion 220. The second linking arms 523 extend respectively and radially from the front and rear segments 528, and have a pair of hooking fingers 526 which are disposed at distal ends thereof and which are parallel to the second transverse axle 525.

The first and second linking arms 514, 523 are connected pivotally to each other at intermediate portions thereof such that the first and second linking arms 514, 523 cooperatively confine a space 510 to accommodate movement of the biasing member 41 when the first and second middle segments 517, 523 are inserted into and are retained slidably under the right and left blocking portions 220', 220, respectively.

The push button 60 is disposed to actuate the depressing portion 411 of the biasing member 41, and have left and right hingeably retaining members 63, 64 disposed in an underside thereof, and spaced apart so as to hingeably retain the first and second hooking fingers 515, 526 of the first and second frames 51, 52, respectively.

In the preferred embodiment, the spacing lower portion 412 of the biasing member 41 has an annular flange portion 413 that extends outwardly from a lower end thereof for mounting on the annular mounting area of the sheet member 40. The annular mounting area is preferably provided with an adhesive thereon so that the flange portion 413 can be mounted fixedly thereon. The pair of first linking arms 514 are disposed outboard to the pair of second linking arms 523 in the transverse direction respectively when the first and second linking arms 514, 523 are pivotally connected at the intermediate portions thereof.

Each of the second linking arms 523 has a pin member 522 which extends outwardly and transversely from the intermediate portion thereof. Each of the first linking arms 514 has an elongated slot 512 formed through the intermediate portion thereof. The slot 512 extends along a longitudinal direction of the first linking arm 514 for inserting the pin member 522 of the respective second linking arms 523 therein such that the pin member 522 is movable along the elongated slot 512.

The intermediate portion 511 of each of the first linking arms 514 has a guiding groove 53 disposed in an inner surface thereof distal to the second linking arm 523 that is pivotally connected thereto. The groove 53 extends downwards from an upper surface of the first linking arm 514 in a transverse direction and is communicated with the respective elongated slot 512 so as to guide insertion and slipping of the pin member 522 the respective elongated slot 512 from above.

The elongated slot 512 is of a dimension that, after the first and second linking arms 514, 523 have been pivotally connected to each other, and after the first transverse axle 516 has been initially inserted under the right blocking portion 220', the second transverse axle 525 can be pulled by shifting the pin members 522 in the elongated slots 512 so as to permit the second transverse axle 525 to be slipped over an upper surface of and be disposed under the left blocking portion 220 so as to be retained slidably in the left retaining guideway 21.

Figure 7:
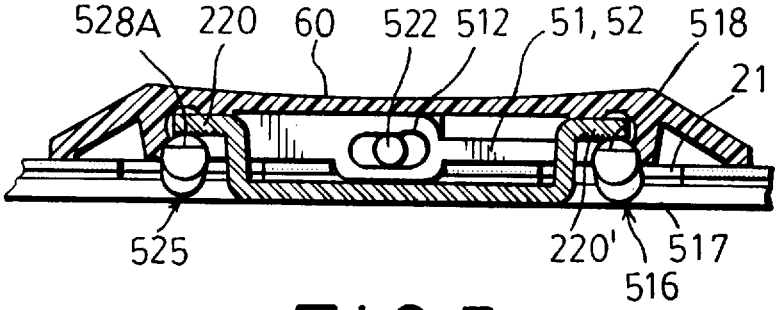
FIG. 7 is a side view of the preferred embodiment in a compressed state.

FIG. 7 illustrates the positions of the pin members 522 in the elongated slots 512 when the push button 60 is compressed. Note that the pin members 522 are moved to the middle position in the elongated slots 512, while the cut-out upper surfaces 518, 528A are spaced relative to the right and left blocking portions 220', 220 respectively, thereby permitting smooth movement of the first and second transverse axles 516, 525 in the right and left retaining guideways 21.

A single punch on the base plate 20 can form the right blocking portion 220' of the right hingeably retaining guideway 21, and correspondingly form the left blocking portion 220 of another computer key.

With this invention thus explained, it is apparent that numerous modifications and variations can be made without departing from the scope and spirit of this invention. It is therefore intended that this invention be limited only as in the appended claims.

I claim:

1. A computer key comprising:

a one-piece base plate including left and right slidably retaining guideways spaced apart from each other in a longitudinal direction of said base plate to define an actuation area therebetween, said left and right slidably retaining guideways being respectively formed by punching said base plate so as to have left and right retaining portions respectively extending uprightly from an upper surface of said base plate, and left and right blocking portions extending respectively from distal ends of said left and right retaining portions away from each other and substantially longitudinal to said base plate so as to block movement in an upward and normal direction relative to a plane of said upper surface, said left and right blocking portions having left and right widths defined in a transverse direction relative to said longitudinal direction of said base plate by front and rear left edges and front and rear right edges, respectively;

a membrane circuit disposed on said upper surface of said base plate, said membrane circuit having a contact area superimposed upon said actuation area, and first left and right openings disposed to match positions of said left and right blocking portions so as to permit extension of said left and right blocking portions outwardly of said first left and right openings;

a flexible sheet member superimposed on said membrane circuit, said sheet member defining an actuation transmitting area and an annular mounting area surrounding said actuation transmitting area, said actuation transmitting area being of a dimension matching that of and being superimposed on said contact area, said sheet member further having second left and right openings aligned with said first left and right openings to permit extension of said left and right blocking portions outwardly through said second left and right openings;

an upright elastomeric biasing member disposed on said mounting seat area of said sheet member, said biasing member including an upper depressing portion and a spacing lower portion to space said upper depressing portion from said mounting seat area, said upper depressing portion being movable against a biasing action thereof to depress said actuation transmitting area as well as said contact area of said membrane circuit to generate an electrical signal;

a first linking frame including:

a first transverse axle oriented in said transverse direction, said first transverse axle having a first middle segment of a first length shorter than said right width and being insertable slidably under said right blocking portion, and first front and rear segments flanking said first middle segment and extending beyond said front and rear edges of said right blocking portion respectively in said transverse direction, each of said first front and rear segments having a cut-out first upper surface such that, while said first middle segment slides under said right blocking portion, said first upper surface will not contact either of said front and rear edges of said right blocking portion;

a pair of first linking arms respectively and radially extending from said first front and rear segments, and having a pair of first hooking fingers disposed at distal ends thereof parallel to said first transverse axle; and a second linking frame including:

a second transverse axle oriented in said transverse direction, said second transverse axle having a second middle segment of a second length shorter than said left width and being insertable slidably under said left blocking portion, and second front and rear segments flanking said second middle segment and extending beyond said front and rear edges of said left blocking portion respectively in said transverse direction, each of said second front and rear segments having a cut-out second upper surface such that, while said second middle segment slides under said left blocking portion, said second upper surface will not contact either of said front and rear edges of said left blocking portion; and a pair of second linking arms respectively and radially extending from said second front and rear segments, said second linking arms having a pair of second hooking fingers disposed at distal ends thereof parallel to said second transverse axle;

said first and second linking arms being connected pivotally to each other at intermediate portions thereof such that said first and second linking arms cooperatively confine a space to accommodate depressing movement of said biasing member when said first and second middle segments are inserted into and are retained slidably under said right and left blocking portions, respectively; and a push button disposed to actuate said depressing portion of said biasing member and having left and right hingeably retaining members disposed in an underside thereof and spaced apart so as to hingeably retain said first and second pairs of hooking fingers, respectively.

2. The computer key as defined in claim 1, wherein said spacing lower portion of said biasing member has a flange portion extending outwardly from a lower end thereof and mounted fixedly on said annular mounting area of said sheet member.

3. The computer key as defined in claim 2, wherein said annular mounting area is provided with an adhesive for mounting of said flange portion thereon.

4. The computer key as defined in claim 1, wherein said pair of first linking arms are disposed outboard to said pair of second linking arms in said transverse direction when said first and second linking arms are connected pivotally at said intermediate portions.

5. The computer key as defined in claim 1, wherein each of said second linking arms includes a pin member extending outwardly and transversely from said intermediate portion of said second linking arm, and each of said first linking arms has an elongated slot formed in said intermediate portion thereof and extending in a longitudinal direction of said first linking arm for inserting said pin member of the respective one of said second linking arms therein such that said pin member is movable along said elongated slot.

6. The computer key as defined in claim 5, wherein said intermediate portion of each of said first linking arms has a guiding groove disposed in an inner surface thereof distal to said second linking arm that is pivotally connected thereto, said guiding groove extending downwardly from an upper surface in a direction transverse to said first linking arms and being communicated with the respective one of said elongated slots so as to guide insertion and slipping of said pin member into the respective one of said elongated slots from above.

7. The computer key as defined in claim 6, wherein said elongated slot is of such a dimension that, after said first and second linking arms have been pivotally connected to each other, and after said first transverse axle has been initially inserted under said right blocking portion, said second transverse axle can be pulled by shifting said pin members in said elongated slots so as to permit said second transverse axle to be slipped over an upper surface of and be disposed under said left blocking portion in order to be slidable in said left retaining guideway.

8. The computer key as defined in claim 1, wherein said right blocking portion of said right hingeably retaining guideway can be formed by a single punching on said base plate, together with formation of said left blocking portion of another computer key.

* * * * *